US006695517B2

(12) United States Patent
Witz et al.

(10) Patent No.: US 6,695,517 B2
(45) Date of Patent: Feb. 24, 2004

(54) FREE INK SYSTEM

(75) Inventors: Wolfgang Witz, Elmhurst, IL (US); Ralf Polley, Wedel (DE); Bernd Bastiansen, Wedel (DE)

(73) Assignee: Sanford, L.P., Freeport, IL (US)

( * ) Notice: Subject to any disclaimer, the term of this patent is extended or adjusted under 35 U.S.C. 154(b) by 46 days.

(21) Appl. No.: 10/106,552

(22) Filed: Mar. 26, 2002

(65) Prior Publication Data

US 2002/0168215 A1 Nov. 14, 2002

Related U.S. Application Data

(60) Provisional application No. 60/278,716, filed on Mar. 26, 2001.

(51) Int. Cl.[7] ..... B43K 8/04
(52) U.S. Cl. ..... 401/198
(58) Field of Search ..... 401/198, 199, 401/196, 202, 205

(56) References Cited

U.S. PATENT DOCUMENTS

| | | | | |
|---|---|---|---|---|
| 1,166,896 A | * | 1/1916 | Garvey | 401/198 |
| 1,413,827 A | | 4/1922 | Briggs | |
| 3,032,802 A | | 5/1962 | Kusama | 15/563 |
| 3,113,336 A | | 12/1963 | Langnickel | 15/563 |
| 3,231,924 A | | 2/1966 | Lofgren | 15/563 |
| 3,442,597 A | | 5/1969 | Hebborn et al. | 401/259 |
| 3,479,122 A | | 11/1969 | Funahashi | 401/199 |
| 3,501,225 A | | 3/1970 | Martin et al. | 401/198 |
| 4,410,290 A | | 10/1983 | Ito et al. | 401/198 |
| 4,496,258 A | | 1/1985 | Tanaka et al. | 401/206 |
| 4,580,918 A | | 4/1986 | Baker et al. | 401/29 |
| 4,588,319 A | * | 5/1986 | Niemeyer | 401/205 |
| 4,753,546 A | | 6/1988 | Witz et al. | 401/258 |
| 5,087,144 A | | 2/1992 | Wada et al. | 401/199 |
| 5,290,116 A | | 3/1994 | Chang | 401/199 |
| 5,352,052 A | | 10/1994 | Kaufmann | 401/199 |
| 5,362,168 A | * | 11/1994 | Abe et al. | 401/206 |
| 5,556,215 A | | 9/1996 | Hori | 401/199 |
| 5,865,553 A | | 2/1999 | Flye Sainte Marie et al. | 401/199 |
| 5,927,885 A | | 7/1999 | Duez et al. | 401/199 |

(List continued on next page.)

FOREIGN PATENT DOCUMENTS

| | | |
|---|---|---|
| CA | 2229409 | 2/1997 |
| CH | 422 575 | 4/1967 |
| DE | 1 511 395 | 9/1973 |
| DE | 95 05 942.2 U1 | 10/1992 |
| DE | 41 15 685 C2 | 1/1995 |

(List continued on next page.)

OTHER PUBLICATIONS

"Complaint for Patent Infringement," Avery Dennison Corporation and DataPrint R. Kaufmann GmbH v. Sanford, Newell Rubbermaid, Inc., and Does 1–20, Case No. 01 00537, United States District Court, Central District of California, Western Division, dated Jan. 18, 2001.

(List continued on next page.)

*Primary Examiner*—Gregory Huson
*Assistant Examiner*—Huyen Le
(74) *Attorney, Agent, or Firm*—Marshall, Gerstein & Borun LLP

(57) ABSTRACT

A free ink marking instrument for dispensing an ink, including a housing, a reservoir for storing ink within the housing, a feed tube to convey ink communicating with the reservoir, a tip disposed within the feed tube for conveying ink to a substrate at a marking end of the tip, a porous buffer disposed within the housing adjacent the feed tube and configured for storing ink during periods of a decreasing pressure differential between the reservoir and the atmosphere, and bubble separation area in the form of either a hole in the feed tube or a hole or passage formed between the feed tube and the tip, is disclosed.

10 Claims, 3 Drawing Sheets

U.S. PATENT DOCUMENTS

| | | | | |
|---|---|---|---|---|
| 6,089,776 | A | 7/2000 | Kaufmann | 401/199 |
| 6,095,707 | A | 8/2000 | Kaufmann | 401/199 |
| 6,183,155 | B1 | 2/2001 | Kaufmann | 401/199 |
| 6,322,268 | B1 | 11/2001 | Kaufmann et al. | 401/198 |
| 6,322,269 | B1 | 11/2001 | Witz et al. | 401/198 |
| 6,474,894 | B1 * | 11/2002 | Baik | 401/225 |

FOREIGN PATENT DOCUMENTS

| | | | |
|---|---|---|---|
| DE | 195 29 865 | A1 | 2/1997 |
| EP | 0 516 538 | A1 | 12/1992 |
| EP | 0 584 149 | B1 | 7/1996 |
| EP | 0 899 128 | A1 | 3/1999 |
| EP | 1 029 708 | A1 | 8/2000 |
| JP | 48-36844 | | 2/1973 |
| JP | 59-12229 | | 4/1984 |
| JP | 2-48377 | | 4/1990 |
| WO | 92/20530 | | 11/1992 |
| WO | 97/06962 | | 2/1997 |
| WO | 98/21052 | | 5/1998 |
| WO | 01/00424 | A1 | 1/2001 |

OTHER PUBLICATIONS

International Preliminary Examination Report for PCT/US00/17575, dated Sep. 14, 2001.

International Search Report for PCT/US00/17575, mail date Oct. 17, 2001.

* cited by examiner

FREE INK SYSTEM

CROSS-REFERENCE TO RELATED APPLICATION

This application claims the benefit under 35 U.S.C. §119(e) of U.S. Provisional Patent Application Serial No. 60/278,716 filed Mar. 26, 2001.

BACKGROUND OF THE INVENTION

1. Field of the Invention

The invention generally relates to marking instruments, and, more specifically, to free ink marking instruments that provide greater hydrostatic stability in response to changes in temperature and pressure, improved ink flow performance, improved design freedom, and ease of manufacture.

2. Brief Description of Related Technology

It is well known to provide a pen having free ink (i.e., liquid ink that can be stored in a cavity and that is free to move or flow in response to external forces such as motion, gravity, and pressure) that a user can selectively apply to a substrate such as paper, metal, or plastic. Such known pens typically include a reservoir for storing the ink and a channel for directing the ink from the reservoir to a marking tip. The ink of such known pens typically has a vapor pressure such that the ink, and any air in the reservoir, expands and contracts in response to changes in ambient temperature and pressure. Such expansion and contraction can cause the ink to leak from the writing tip of the pen, under certain conditions.

Other such known pens include a buffer for storing ink that would otherwise leak through the tip in response to changes in ambient temperature and pressure. The excess ink is typically stored in the front of the buffer, near the tip of the pen, due to gravity, when the pen is in the tip-down position. However, such known pens have several disadvantages: the ink capacity of the buffer is limited such that when the buffer is full the excess ink leaks from the pen, and the ink is often permanently stored in the buffer resulting in decreased buffer capacity and wasted ink. Another of such known pens provides for the clearing of ink from the buffer when the pressure inside the pen increases by venting air into the pen through an external vent. Such known pens, however, clear only a small portion of the buffer. Still other pens have achieved hydrostatic stability, but only with design restrictions that require stringent manufacturing tolerances and result in reduced ink flow rates.

Accordingly, it would be desirable to provide a hydrostatically stable pen that responds to repeated temperature and pressure changes without substantially leaking or dripping, and that permits greater design freedom and ink flow rates.

SUMMARY OF THE INVENTION

It is an objective of the invention to overcome one or more of the problems described above.

Accordingly, one aspect of the invention is a free ink marking instrument for dispensing an ink, including a housing, a reservoir for storing ink within the housing, a feed tube to convey ink communicating with the reservoir, a tip disposed within the feed tube for conveying ink to a substrate at a marking end of the tip, a porous buffer disposed within the housing adjacent the feed tube and configured for storing ink during periods of a decreasing pressure differential between the reservoir and the atmosphere, and a vent hole in the feed tube, wherein the vent hole is disposed at a distance greater than the length of the tip, measured from the marking end of the tip.

Another aspect of the invention is a free ink marking instrument for dispensing an ink including a housing, a reservoir for storing ink within the housing, a feed tube to convey ink communicating with the reservoir, wherein the feed tube has primary and secondary ends at one extremity, a tip disposed within the feed tube end for conveying ink to a substrate at a marking end of the tip, a porous buffer disposed within the housing adjacent the feed tube and configured for storing ink during periods of a decreasing pressure differential between the reservoir and the atmosphere, and a vent hole formed between a secondary end of the feed tube and a butt end of the tip.

Still another aspect of the invention is a free ink marking instrument for dispensing an ink including a housing, a reservoir for storing ink within the housing, a feed tube to convey ink communicating with the reservoir, a tip disposed within the feed tube for conveying ink to a substrate at a marking end of the tip, a porous buffer disposed within the housing adjacent the feed tube and configured for storing ink during periods of a decreasing pressure differential between the reservoir and the atmosphere, and a passage between the outside surface of the tip and the inside surface of the feed tube, wherein the passage has a mean thickness of about 0.010 inches (in.) to about 0.025 in. (about 0.254 mm to about 0.635 mm).

Further aspects and advantages of the invention may become apparent to those skilled in the art from a review of the following detailed description, taken in conjunction with the appended claims. While the invention is susceptible of embodiments in various forms, described hereinafter are specific embodiments of the invention with the understanding that the disclosure is illustrative, and is not intended to limit the invention to the specific embodiments described herein.

DETAILED DESCRIPTION OF THE INVENTION

Figure 1:
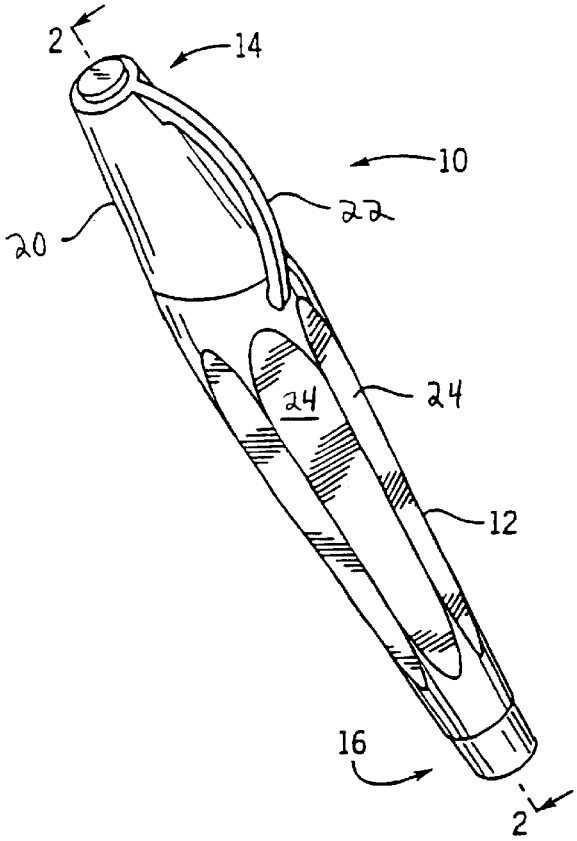
FIG. 1 is a perspective view of a marking instrument according to one embodiment of the invention.

The invention is directed to a marking instrument of the free ink type that achieves improved ink flow and ease of manufacture, while maintaining hydrostatic stability over a range of temperature and pressure changes. The advantages of the invention are achieved, in part, by designing the writing instrument to have a bubble separation area that is near the writing end of the tip. Consistent with the teachings in U.S. Pat. No. 4,753,546 (Jun. 28, 1988), the disclosure of which is incorporated herein by reference, the closer the bubble separation area is to the writing end of the tip, the greater the allowable mean radius of curvature of the bubble separation area, for a fluid of a given surface tension.

Thus, for example, by designing a writing instrument to have a bubble separation area close to the writing end of the tip, the writing instrument can be designed to incorporate a bubble separation area in the form of a vent hole or passage directly to the free ink (i.e., to the free ink reservoir or an extension thereof), wherein the vent hole or passage has a suitable mean radius of curvature.

One aspect of the invention is a free ink marking instrument for dispensing an ink, including a housing, a reservoir for storing ink within the housing, a feed tube to convey ink communicating with the reservoir, a tip disposed within the feed tube for conveying ink to a substrate at a marking end of the tip, a porous buffer disposed within the housing adjacent the feed tube and configured for storing ink during periods of a decreasing pressure differential between the reservoir and the atmosphere, and a vent hole in the feed tube, wherein the vent hole is disposed at a distance greater than the length of the tip, measured from the marking end of the tip.

Another aspect of the invention is a free ink marking instrument for dispensing an ink including a housing, a reservoir for storing ink within the housing, a feed tube to convey ink communicating with the reservoir, wherein the feed tube has primary and secondary ends at one extremity, a tip disposed within the feed tube end for conveying ink to a substrate at a marking end of the tip, a porous buffer disposed within the housing adjacent the feed tube and configured for storing ink during periods of a decreasing pressure differential between the reservoir and the atmosphere, and a vent hole formed between a secondary end of the feed tube and a butt end of the tip.

Still another aspect of the invention is a free ink marking instrument for dispensing an ink including a housing, a reservoir for storing ink within the housing, a feed tube to convey ink communicating with the reservoir, a tip disposed within the feed tube for conveying ink to a substrate at a marking end of the tip, a porous buffer disposed within the housing adjacent the feed tube and configured for storing ink during periods of a decreasing pressure differential between the reservoir and the atmosphere, and a passage between the outside surface of the tip and the inside surface of the feed tube, wherein the passage has a mean thickness of about 0.002 in. to about 0.020 in. (about 0.051 mm to about 0.508 mm). The thickness of the passage is measured as the distance between an outer surface of a tip and the adjacent surface of a feed tube (e.g., the outer surface of a tip and the inner surface of a feed tube, or a shoulder of a tip and an end of a feed tube).

Yet another aspect of the invention is a free ink writing instrument that conveys free ink from an ink reservoir (or an extension thereof) directly to the tip material.

Preferably, the marking instrument has a length of about 3 inches to about 7 inches (about 7.6 cm to about 18 cm), more preferably about 4 inches to about 5.5 inches (about 10 cm to about 14 cm). The housing preferably is about ⅜ in. to about 1 in. (about 0.95 cm to about 2.5 cm) wide at its narrowest point, and about ⅜ in. to about 1¼ in. (about 0.95 cm to about 3.2 cm) wide at its widest point.

The bubble separation area preferably is located at about 0.5 in. to about 1.5 in. (about 1.3 cm to about 3.8 cm) from the marking end of the tip, more preferably about 0.8 in. to about 1.2 in. (about 2 cm to about 3 cm), when the instrument is used with a fluid having a surface tension in the range of about 15 dyne/cm to 55 dyne/cm.

The mean radius of curvature of the bubble separation area is in a range of about 0.002 in. to about 0.012 in. (about 0.051 mm to about 0.305 mm), preferably about 0.004 in. to about 0.008 in. (about 0.102 mm to about 0.203 mm) when the instrument is used with a solvent-based ink and preferably about 0.006 in. to about 0.010 in. (about 0.152 mm to about 0.254 mm) when used with a water-based ink.

When the bubble separation area is a passage between the outside surface of the tip and the inside surface of the feed tube, the passage has a mean thickness of about 0.002 in. to about 0.020 in. (about 0.051 mm to about 0.508 mm), more preferably about 0.012 in. to about 0.016 in. (about 0.305 mm to about 0.406 mm) when the instrument is used with a solvent-based ink and about 0.014 in. to about 0.020 in. (about 0.356 mm to about 0.508 mm) when the pen is used with a water-based ink.

When the bubble separation area is a circular vent hole, the hole has a diameter of about 0.005 in. to about 0.025 in. (about 0.127 mm to about 0.635 mm) more preferably about 0.008 in. to about 0.012 in. (about 0.102 mm to about 0.305 mm) when the instrument is used with a solvent-based ink and about 0.014 in. to about 0.022 in. (about 0.356 mm to about 0.559 mm) when used with a water-based ink. One or more holes can be made in the feed tube by suitable means such as puncturing the feed tube with an object such as a needle, and by the use of a laser. One or more holes is provided on the feed tube, preferably two to four holes, most preferably two holes.

FIG. 1 shows a writing or marking instrument such as a pen or highlighter (shown as a marker 10) according to one embodiment of the invention. In the various drawing figures, like numerals are used to indicate like elements. The marker 10 includes a body 12 disposed between a writing end 14 and a butt end 16. A removable cap 20 having a clip 22 is shown attached to the writing end 14 of the body 12. The cap 20 can be sized to engage the butt end 16 for storage of the cap 20 during use of the marker 10. According to any preferred or alternative embodiment, a flexible or rigid grip 24 surrounds at least a portion of the body 12.

Figure 2:
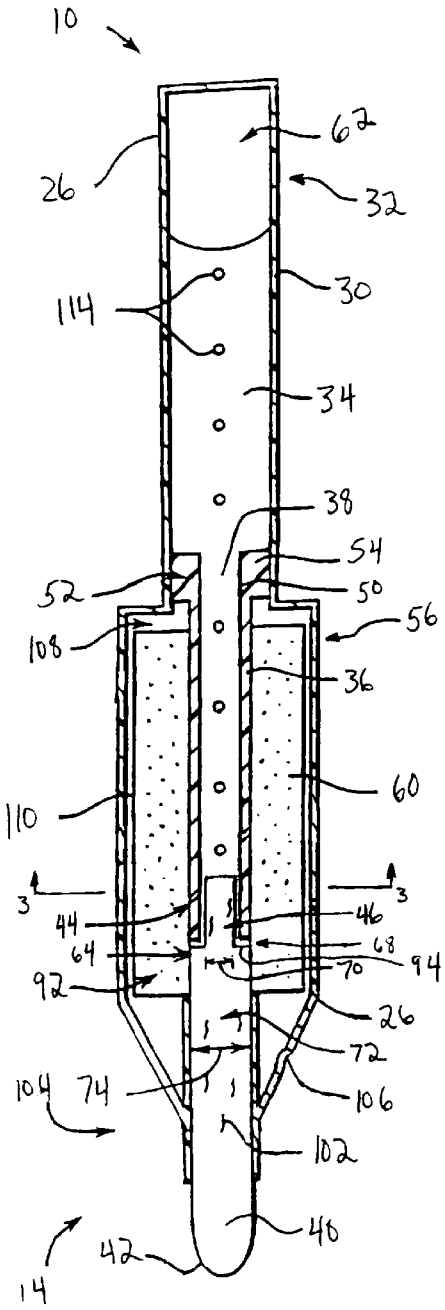
FIG. 2 is a stylized cross-sectional view of the marking instrument of FIG. 1 taken along line 2—2 of FIG. 1, illustrating functional components of the instrument.

FIG. 2 shows a stylized cross-sectional view of the marker 10 of FIG. 1, illustrating functional components of the instrument. The marker 10 includes a housing 26 (e.g., provided by an exterior wall 30). A reservoir 32 for storing a free ink 36 is within the housing 26. The term "free ink" is defined a liquid ink that can be stored in a cavity (e.g., a reservoir) and that is free to move or flow in responses to external forces (e.g., motion, gravity, and pressure). A user may view such free ink in a column of a writing instrument (e.g., a portion of the reservoir) to determine how much ink is available for use.

Figure 3:
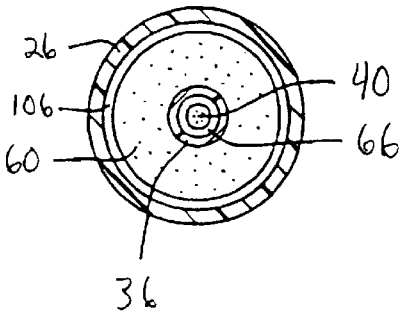
FIG. 3 is a cross-sectional view of the marking instrument of FIG. 2 taken along line 3—3 of FIG. 2.

A non-porous feed tube 36 provides an open channel 38 in fluid communication with the reservoir 32 as an extension of the reservoir 32 for transferring ink 34 from the reservoir 32, through the tip 40 to its marking or writing end 42. A lower section 44 of the feed tube 36 is adapted to receive a butt end 46 of the tip 40. The feed tube 36 has an adapter 50 at a section 52 of the feed tube 36 nearest the reservoir. A plenum (shown as a head 54) of the adapter 44 separates the reservoir 32 from a lower section 56 of the marker 10 and secures the feed tube 36. A buffer 60 surrounds the feed tube 36 and at least a portion of the tip 40 (see FIGS. 2 and 3) to provide capillary coupling between the tip 40 and the buffer 60.

The reservoir 32 provides an area for storing ink 34 as shown in FIG. 2. A headspace 62 of air and vapor is located above the ink 34 when the instrument is in the tip-down position, as shown. The headspace 62 expands and contracts in response to changes in temperature and pressure. The ink 34 in the reservoir 32 typically has a relatively high vapor pressure, so that it can dry quickly when used, and it responds significantly to changes in temperature and pressure. A variety of inks, such as solvent-based (e.g., alcohol) or water-based inks, may be used with the writing instrument, and the physical properties of different inks may dictate slight differences in the writing instrument (e.g., shapes, sizes, geometries, tip compositions, bubble separation area location).

According to alternative embodiments, the ink 34 can be water-based and can contain pigments, such as those inks used in MAJOR ACCENT brand highlighters and liquid paint felt-tip marking and coloring applicators commercially available from Sanford Corporation (Bellwood, Ill.). According to other embodiments, the ink 34 can be alcohol and dye-based, such as those inks used in SHARPIE brand marking and writing pens commercially available from Sanford Corporation. According to still other alternative embodiments, the ink 34 can be alcohol and pigment-based, such as those inks used in EXPO brand and EXPO2 brand white board marker pens and dry erase marking pens commercially available from Sanford Corporation of Bellwood, Ill. According to a preferred embodiment, the ink 34 is compatible with a plastic material such as polypropylene.

The head 54 of the adapter 50 can be held by interference fit within the housing 26 as shown in FIG. 2. The feed tube 36 of the adapter 50 limits the engagement between the open channel 38 of ink and the buffer 60. The buffer 60 and the tip 40 are in sufficient contact at a middle section 64 of the tip 40 to provide capillary coupling between the tip 40 and the buffer 60 for transfer of ink to and from the buffer 60 during changes in temperature and/or pressure. The length of the feed tube 36 of the adapter 50 also limits the location where the ink has access to the buffer 60. According to a particularly preferred embodiment as shown in the drawing figures, the head 54 of the adapter 50 is integral with the feed tube 36 to form a unitary piece (e.g., a molded piece). The feed tube 36 preferably is made of a plastic, such as polypropylene, which is generally compatible with the ink. In the embodiment shown in FIG. 2, the butt end 46 of the tip 40 does not engage the feed tube 36, but instead there is sufficient clearance to form a passage 66 to provide a bubble separation area 68 (see also FIG. 4) approximately in the shape of a toroid or an annulus with a height measured as the distance between a shoulder 94 and the lowermost (as shown) end of the feed tube 36.

In the embodiment of the invention depicted in FIG. 2, the butt end 46 of the tip 40 has a first diameter 70 and the middle section 64 (and, optionally, lower section 72) of the tip 40 has a second, larger, diameter 74, but this need not be the case. Thus, as in the embodiment depicted in FIG. 5, a tip 140 can have a substantially uniform diameter 76, which provides a passage 66 (not labeled) between a butt end 146 of the tip 140 and the feed tube 36. For example, the butt end 146 of the tip 140 is not engaged in interference fit with the feed tube 36, but instead a degree of clearance is present. In such a case, the tip 140 preferably is prevented from ascending further up into the feed tube 36, or from coming out of the feed tube 36 by being physically secured, such as by the combination of a circumferential notch 78 in the tip 140 and a corresponding ridge 90 in the housing 26, or by other means. In addition, in the case of this embodiment employing a tip 140, a buffer 160 is adapted to be in capillary communication with the tip 140 in the vicinity of a tip end 192 of the buffer 160 to ensure that the ink can move from the tip 140 to the buffer 160 and from the buffer 160 to the tip 140. Preferably, a molded material can provide the desired contact between the buffer 160 and tip 140.

Referring to FIG. 2, when the tip 40 has a butt end 46 with a first diameter 70 and a middle section 64 (and, optionally, lower section 72) of the tip 40 with a second, larger, diameter 74, the middle section 64 has a ridge (shown as a shoulder 94) that is located proximate the lower section 44 of the feed tube 36. The butt end 46 of the tip 40 extends from the shoulder 94 to a predetermined distance up into the feed tube 36. The middle section 64 of the tip 40 extends from the shoulder 94 to the lowermost end of the buffer 60, and the lower section 72 of the tip 40 extends from the lowermost end of the buffer 60 to the marking end 42, which is used to contact a substrate for delivery of ink.

The tip 40 preferably is comprised of synthetic resin fibers 102 oriented in a generally vertical direction as shown in FIG. 2. According to a preferred embodiment, the fibers 102 are irregularly shaped and are somewhat randomly distributed in the tip 40. According to a preferred embodiment, the tip 40 has a circular cross section. According to alternative embodiments, the tip 40, especially the upper portion 46, can have a variety of shaped cross sections (e.g., toothed, jagged, smooth, etc.) to provide increased surface area. Suitable tip 40 material, such as acrylic linear fiber material, is commercially available from Teibow Co. Ltd. of Hamamatsu-shi, Shizuoka-ken, Japan. Another suitable tip 40 material is a polyester linear fiber, which is commercially available from Aubex Co. of Tokyo, Japan. According to an alternative embodiment, the tip 40 can be made of felt or synthetic resin foam.

A tip holder 104 attaches the tip 40 to the housing 26, as shown in FIG. 2. The marking end 42 of the tip 40 is shown in FIG. 2 having a parabolic shape, but this need not be the case. According to alternative embodiments, the marking end 42 can have one of a variety of shapes such as a chisel shape, a chisel with an angle, pointed or rounded shapes, etc. Without intending to be limited to any particular theory, it is believed that the larger the surface area of the marking end 42, the lower the capillary pressure of the marking end 42 when it is saturated with ink. Such reduced capillary pressure of the marking end is described by LaPlace, who theorized that the pressure across an interface is proportional to the surface tension of the liquid and inversely proportional to the mean radius of curvature of such liquid. The LaPlace equation and its application to fluid ink delivery systems is described in U.S. Pat. No. 4,753,546.

For proper function of the marker 10, the capillarity of the tip 40 should be greater than the capillarity of the buffer 60 and the channel 38. Thus, the tip 40 (and, importantly, the marking end 42) remains wet with ink regardless of the ink distribution inside the marker 10, such that the marker 10 is always ready to make marks on the substrate during the act of writing. The term "capillarity" can be defined as the height to which a liquid (e.g., ink) ascends within a pore of a capillary having a given height and diameter, and includes the attractive capillary force (i.e., capillary pressure) of the liquid to the capillary. Without intending to be limited by any particular theory, it is believed that capillary force is inversely proportional to both the pore size of a capillary, the storage capacity of a capillary, and the fractional filling of the capillary.

The buffer 60 can be porous and includes a volume sufficient to retain ink and air in response to changes in temperature and/or pressure within the reservoir 32. If the ink-retaining capacity of the buffer 60 is not exceeded, then the capillary pressure of the buffer 60 will retain excess ink. An air intake (shown as an air entry hole 106) in the housing 26 can provide an air vent in communication with the atmosphere. (Air can also enter the marker 10 through capillary spaces surrounding the tip 40 at the tip holder 104.) A space for holding air (shown as a gap 108) surrounds an exterior surface 110 of the buffer 60. Air from hole 106 can enter the buffer 60 through the external surface 110. The size of the buffer 60 can be selected in accordance with the air volume of the marker 10 needed to hold the quantity of excess ink. According to a preferred embodiment, the buffer 60 has a capacity of about 40% relative to the size of the reservoir 32. According to a particularly preferred embodiment, the buffer 60 can retain or store about 2 ml to about 4 ml of ink.

The buffer 60 can be made of a material selected from a variety of fibrous or porous materials, and its porosity and capillary nature can be selected for compatibility with the particular ink used in the instrument. According to a preferred embodiment of the invention, the buffer 60 is made from a hydrophilic (product no. D-2605) or a hydrophobic (product no. D-2611) linear polyolefin resin fiber commercially available from Filtrona Richmond, Inc. of Richmond, Va. A hydrophilic material is preferred for use with water-based inks. A hydrophobic material can be used for solvent-based inks, and can be modified for use with water-based inks. According to alternative embodiments, the buffer 60 can be made of a material selected from ceramics, porous plastics such as open cell foams, acrylics, sponges, etc., and combinations thereof. According to other alternative embodiments, the buffer 60 can be made of hydrophillic or hydrophobic foam, such as polyurethane.

The air and vapor in the reservoir 32 responds to changes in pressure and temperature. At equilibrium, the pressure of the air and vapor in the reservoir 32 is at a pressure slightly less than ambient pressure, due to the height of the ink in the reservoir 32 above the marking end 42. The term "ambient pressure" is defined as the pressure of the atmosphere outside of the marker. At such slightly lower pressure of air and vapor in the reservoir 32, the ink is retained in the marker 10. To begin the act of writing with the marker 10, ink travels from the channel 38 through the tip 40 to its marking end 42. If any ink is stored in the buffer 60 during writing, such stored ink is preferentially taken by the tip 40 because of the greater capillarity of the tip 40 relative to the buffer 60.

When the cap 20 is removed from the body 12, the marker 10 responds to changes in ambient pressure and ambient temperature (i.e., pressure and temperature differentials) to reach equilibrium (i.e., the pressure slightly less than ambient pressure). The term "pressure differential" is defined as the difference in pressure between the air and vapor inside the reservoir 32 (e.g., the headspace 62) and ambient pressure. The term "increasing pressure differential" is defined as the increase in pressure of the air and vapor inside the reservoir 32 in response to an increasing ambient pressure. The term "decreasing pressure differential" is defined as the decrease in pressure of the air and vapor inside the reservoir 32 in response to a decreasing ambient pressure. Without intending to be limited to any particular theory, it is believed that the air and vapor inside the marker 10 responds directly to changes in ambient pressure and temperature to reach equilibrium.

An increasing pressure differential situation occurs, for example, during a descent in a pressurized airplane. If the ink is stored in the buffer 60 during an increasing pressure differential situation, then the tip 40 seeks ink from the buffer 60 and the channel 38 seeks ink from the tip 40 and the buffer 60. If the buffer 60 is substantially free of ink during an increasing pressure differential situation, then the reservoir 32 could draw in air through the buffer 60 at the bubble separation area 68. ink and air flow behaves similarly when a user writes with and discharges ink onto a substrate (e.g., paper, cloth, marker board, metal, plastic, etc.). Thus, the tip 40 draws ink preferentially from the buffer 60, if saturated, and then from the reservoir 32.

During an increasing pressure differential situation (or decreasing temperature differential situation) when the buffer 60 is near empty (i.e., substantially free of ink), the difference in pressure between the air and vapor in the reservoir 32 and ambient pressure may become so great that a bubble pressure of the marker 10 is reached. The term "bubble pressure" is defined as the pressure differential necessary to draw or vent external air through the hole 106, the buffer 60, the passage 66, the channel 38, and ultimately into the reservoir 32. Such venting of air adds to the volume of air in the reservoir 32 to maintain the pressure differential between the air in the reservoir 32 and ambient conditions outside of the marker 10 at a relatively constant level. The vented air is preferentially drawn through the bubble separation area 68, the passage 66, and the channel 38 into reservoir 32 (rather than through the tip 40) because the bubble separation area 68 has a larger capillary space and, thus, lower resistance, available for the air than does the tip 40. The increasing pressure differential transports ink and/or air, while the tip 40 remains wet with ink for quick writing and reduced leakage.

As the ambient pressure and temperature changes, the air inside the reservoir 32 will expand and contract and accordingly force the ink through the tip 40 and into (or out of) the buffer 60. If insufficient ink exists in the buffer during an increasing pressure differential situation, then air (shown in the ink phase as bubbles 114) enters the reservoir 32 through the passage 66 creates the desired equilibrium. During such increasing pressure differential situation, air will first urge ink out of the buffer 60, and then will follow the path of least resistance and will accordingly migrate toward the bubble separation area 68 (since the air would not substantially enter the tip 40 through the adapter 50 or feed tube 36).

The marker 10 can also experience a decreasing pressure differential situation. A decreasing pressure differential situation occurs, for example, during an ascent in a pressurized airplane, during which ambient pressure can decrease to about two-thirds that of normal atmospheric pressure (i.e., two-thirds of one atmosphere (one atmosphere is equal to 760 mm mercury)). As a result of a decreasing pressure differential, air in the reservoir 32 expands, forcing the ink toward the marking end 42 of the tip 40. If the buffer 60 is not fully saturated with ink during a decreasing pressure differential situation, then the buffer 60 (due to its capillary force) will absorb excess ink 34 from the reservoir 32. Because the marker 10 can compensate for both increasing and decreasing pressure and temperature differentials, the hydrostatic balancing of air in the marker 10 can be achieved to provide a constant flow of ink when in use, and to inhibit the ink from dripping or leaking from the marking end 42 when the marker 10 is oriented in any direction (e.g., horizontal, vertical, etc.).

Figure 4:
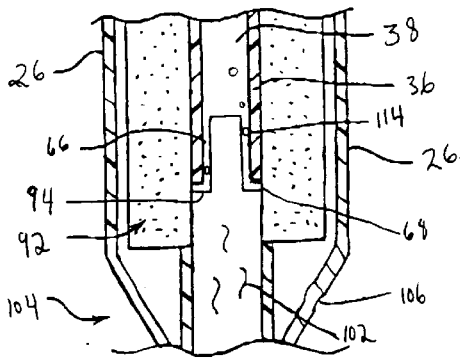
FIG. 4 is an enlarged fragmentary cross-sectional view of an area of the marking instrument of FIG. 2.

The arrangement of the tip 40 and the feed tube 38 provides a bubble separation area 68, as shown in FIG. 4. The bubble separation area 68 is located in the vicinity of the shoulder 94 of the tip 40 between the buffer 60 and the first diameter 70 to allow bubbles 114 to form and rise in the passage 66 to the surface of the ink 34 in the reservoir 32. The location of the bubble separation area 68 near the marking end 42 functions to purge the tip end 92 of the buffer 60 of ink during an increasing pressure differential situation. The location of the bubble separation area 68 is advantageous for at least four reasons: it assists in more completely emptying or purging the buffer 60 of ink in the worst-case, tip-down orientation; it reduces the accumulation of the ink in the tip end 92 of the buffer 60, which could otherwise contribute to leakage of ink from the marker 10; it decreases the static height above the tip 40 to make the instrument more stable from a hydrostatic point of view; and it allows better ink flow.

Figure 6:
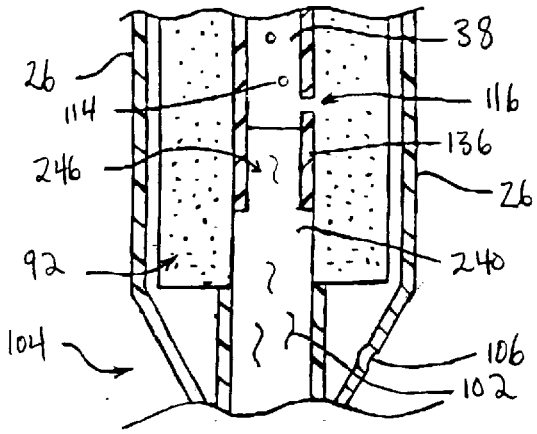
FIG. 6 is an enlarged fragmentary stylized cross-sectional view of an area of another embodiment of a marking instrument of the invention, illustrating functional components of the instrument.

FIG. 6 shows an alternative embodiment of a portion of a marker 10, wherein a tip 240 has a butt end 246 engaged in interference fit against the feed tube 136 and bubble separation area 68 in the form of a vent hole 116 is provided for air transfer between the buffer 60 and the channel 38. The vent hole 116 provides a bubble separation area 68 at a fixed distance from the marking end 42. Consistent with the inventor's teaching in U.S. Pat. No. 4,753,546, the height of the bubble separation area 68 (e.g., vent hole 116) at a linear distance (i.e., in a straight line parallel to the axis of the marker 10) from the marking end 42 (not shown) will determine the allowable mean radius of curvature of the bubble separation area (e.g., vent hole 116), for a liquid having a given surface tension, for the marker 10 to maintain hydrostatic stability. Thus, the mean radius of curvature of vent hole 116 can increase as the vent hole 116 approaches the marking end 42, and can decrease as the vent hole 116 is disposed further from the marking end 42.

Figure 5:
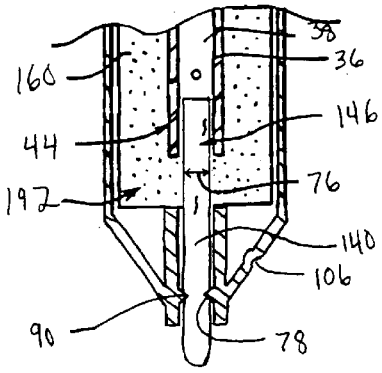
FIG. 5 is a fragmentary stylized cross-sectional view of another embodiment of a marking instrument of the invention, illustrating functional components of the instrument.

The embodiment of FIG. 6 can, in an alternative embodiment, be modified such that the tip does not have a shoulder 94, as shown in FIG. 2, but instead has a constant diameter (adapted to provide interference fit with a feed tube), and is secured from movement in the axial direction (such as with a notch 78 and ridge 90 arrangement shown in FIG. 5).

Figure 7:
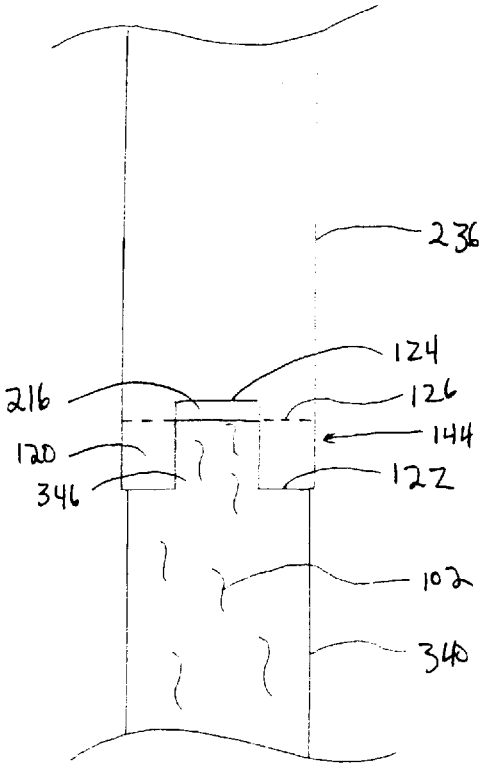
FIG. 7 is an enlarged side view of feed tube and tip components of another embodiment of a marking instrument of the invention.
Figure 8:
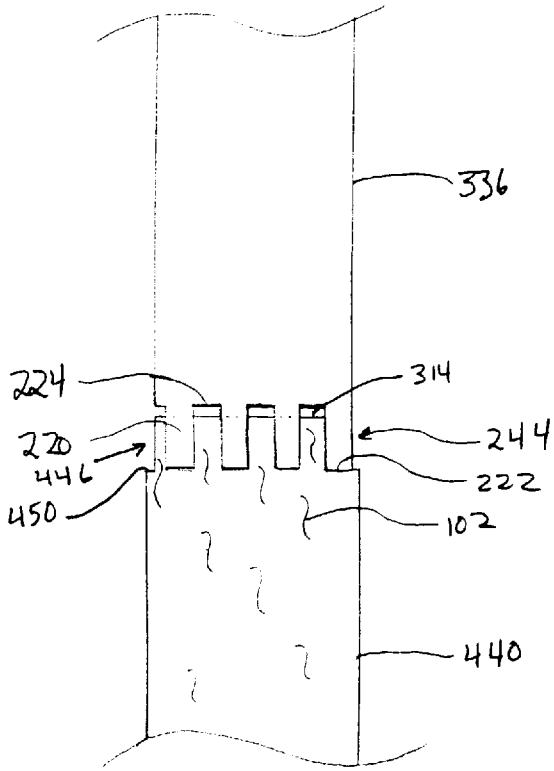
FIG. 8 is an enlarged side view of feed tube and tip components of another embodiment of a marking instrument of the invention.

FIGS. 7 and 8 exemplify another class of feed tube embodiment wherein the feed tube has a lower (as shown) extremity 144 with a non-uniform cross-section, such as notched, crenated, scalloped, toothed, denticulated, serrated, etc. In FIG. 7 a feed tube 236 having a wide castellated lower extremity 144 (i.e., having wide fingers 120) forms primary ends 122 (which can also be thought of as the ends of the fingers 120) and secondary ends 124. The feed tube 236 has at least one finger 120, preferably at least two fingers 120. The distance between the primary ends 122 and the secondary ends 124 preferably is uniform and can be selected to provide the desired fit with a butt end 346 of the tip 340 and the desired mean radius of curvature of the hole 216. In this embodiment the hole 216 provides bubble separation area that is a fixed distance from the marking end 42.

The butt end 346 of the tip 340 preferably is engaged in interference fit with the fingers 120 of the feed tube 236 at the lower extremity 144. The heel 126 of the tip 340 (indicated with phantom lines behind the fingers 120) is shown as being arranged to leave a vent hole 216, but this need not be the case. The heel 126 of the tip 340 can also be arranged with the feed tube 236 to provide no vent hole 216, either by the heel 126 coinciding with the secondary ends 124, or by the heel 126 being above the secondary ends 124. When the arrangement of the tip 340 and feed tube 236 does not provide a vent hole 216, preferably the feed tube will have a vent hole above the heel 126.

FIG. 8 shows a feed tube 336 having a narrow castellated lower (as shown) extremity 244 (i.e., having more, narrow fingers 220) that forms primary ends 222 (which can also be thought of as the ends of the fingers 220) and secondary ends 224. The distance between the primary ends 222 and the secondary ends 224 preferably is uniform and can be selected to provide the desired fit with the butt end 446 of a tip 440 and the desired mean radius of curvature of vent holes 314, if present, formed with the tip 440.

The butt end 446 of the tip 440 preferably is engaged in interference fit with the fingers 220 of the feed tube 336 at the lower extremity 244. In the arrangement shown, the butt end 446 of the tip 440 has a smaller diameter than the remainder of the tip 440, and forms a shoulder 450 which abuts against the primary ends 222 of the fingers 220 to prevent the tip 440 from traveling further into the feed tube 336.

Figure 9:
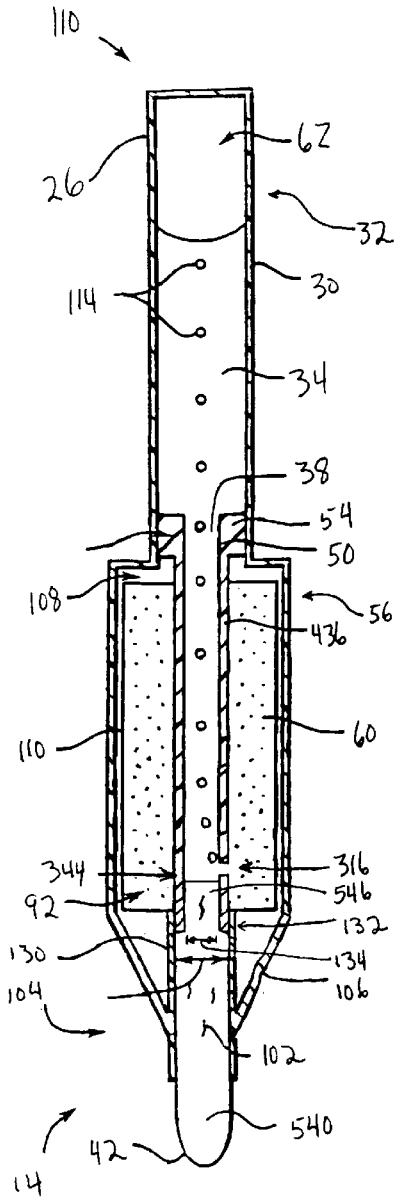
FIG. 9 is a stylized cross-sectional view of another embodiment of a marking instrument of the invention, illustrating functional components of the instrument.

Another embodiment of a marker according to the invention, marker 110, is shown in FIG. 9. In the marker 110, a feed tube 436 has been lengthened and adapted to join with a section 130 of the tip holder 104 (e.g., as shown in FIG. 9 by interference fit at region 132). The feed tube 436 has been provided with a vent hole 316 to serve as a fixed bubble separation point. The butt end 546 of the tip 540 has a diameter 134 that is less than the diameter 142 of the remainder of the tip 540, to provide a shoulder that abuts a shoulder of the feed tube 436 at the lower (as drawn) end 344 of the feed tube 436. The butt end 546 of the tip 540 preferably is engaged in interference fit with the feed tube 436. In this embodiment, there is no contact between the tip 540 and the buffer 60. In response to changes in temperature and pressure, ink will be conveyed directly to or from the buffer 60. Similarly, in an increasing pressure differential situation, when the buffer 60 is depleted of ink, the reservoir 32 will draw in air via the channel 38 through the vent hole 316 from the buffer 60. In an alternative embodiment (not shown), the tip can have a constant diameter and be engaged in interference fit with a feed tube that has a vent hole. In such an embodiment, the tip preferably is secured to prevent movement of the tip in the axial direction.

Previous free ink marking instruments have employed an additional member, such as an additional fibrous member sometimes referred to as an ink feeder or capillary conveying line, to convey ink from the reservoir to the tip of the marker. Manufacturing procedures typical for such instruments contained inefficiencies and secondary problems that are eliminated in a manufacturing procedure for a marking instrument according to the invention.

Thus, for example, in a previous manufacturing procedure a butt end of a housing including a reservoir space was positioned with its open end up and filled with ink. Next, an adapter and, optionally, a tube were seated in the housing. When an adapter with tube was used, the insertion of the adapter and tube into the ink-filled housing caused ink to rise within the tube. Next, a feeder was placed at least partially in the tube, and the process was halted for sufficient time for the feeder to absorb ink from the tube, typically about 10 seconds. After the tip was substantially filled with ink, an additional force was applied to the feeder to complete insertion into the tube.

If the instrument was used with a dye-based ink, a buffer was inserted from the top, over the feeder, and pushed to about ½ the distance to its seated position in the completed instrument, then a second portion of the housing in the form of a ferrule that included a tip holder was inserted over the buffer and pressed down to seat the buffer and engage the ferrule with the butt end of the housing. Finally, a tip was inserted through the ferrule and brought into contact with the feeder.

If the instrument was used with a pigment-based ink, a cylindrical buffer, inserted from the top, was pushed down a distance such that the top of the feeder was about ¼ of an inch (about 6.4 mm) above the top of the feeder, and a small amount of ink (about 1 ml to about 2 ml) was placed on top of the feeder and buffer. The ink assisted in assuring that the tip was wetted with pigmented ink on its first use. Next, a second portion of the housing in the form of a ferrule that included a tip holder was inserted over the buffer and pressed down to seat the buffer and engage the ferrule with the butt end of the housing. In so doing, ink from the top of the buffer could come into contact with the lower end of the ferrule, and eventually spread to the outer surface of the marking instrument, which also caused ink to come into contact with the manufacturing equipment and, in some cases, pens that otherwise would have had a clean outer surface.

For marking instruments with either type of ink, the pens were subsequently inverted (i.e., placed in a tip-down orientation) for about four hours to ensure that the ink traveled to the marking end of the tip and the marking instrument "started" on its first use.

For a marking instrument according to the invention, several efficiencies of production are realized. In a manufacturing procedure for a marking instrument according to the invention, a butt end of a housing is positioned with an open end up, and an adapter with a feed tube is seated in the housing. The ink can be added to the reservoir either before insertion of the adapter and feed tube, or after insertion of the adapter and feed tube; in the latter case, the ink is filled through the feed tube. Next, a buffer is placed within the housing. A tip is then inserted into the adapter tube, and the tip and adapter tube guide the ferrule as it is inserted down over the tip to engage the butt end of the housing and, simultaneously, the ferrule guides the tip into the tip holding portion of the ferrule. In another expedient, the tip can be inserted before the buffer is placed in the housing, and can be used to guide the buffer into the housing. In still another expedient, the ferrule can be seated prior to insertion of the tip; in this case, the ferrule tube can guide the adapter tube towards the tip holder, and the tip is inserted from the top, through the ferrule. Finally, for any type of ink, the marking instruments need to be inverted for only a few minutes to ensure that the instrument starts upon its first use. Thus, a manufacturing process for an instrument according to the invention has the advantages of eliminating any process step for waiting for a feeder to absorb ink, eliminating the possibility that a pigment-based ink will reach the outer surface of the instrument, and allowing for fast-starting marking instruments.

The foregoing description is given for clearness of understanding only, and no unnecessary limitations should be understood therefrom, as modifications within the scope of the invention may be apparent to those having ordinary skill in the art.

What is claimed is:

1. A free ink marking instrument for dispensing an ink, comprising:

a housing;

a reservoir for storing fluid ink within the housing;

a feed tube to convey fluid ink, communicating with the reservoir;

a porous tip disposed within the feed tube for conveying ink to a substrate at a marking end of the tip;

a porous buffer disposed within the housing adjacent the feed tube and configured for storing ink during periods of a decreasing pressure differential between the reservoir and the atmosphere; and a vent hole in the feed tube, the vent hole being disposed at a distance greater than the length of the tip, measured from the marking end of the tip.

2. The instrument of claim 1, wherein a vent hole is disposed at about 0.5 in. to about 1.5 in. from the marking end of the tip.

3. The instrument of claim 1, wherein a portion of the buffer is in disposed in capillary coupling contact to a portion of the tip.

4. The instrument of claim 1, wherein the tip is isolated from contact with the buffer.

5. The instrument of claim 1, wherein the tip comprises a shoulder near the end of the tip disposed within the feed tube, and the end of the feed tube abuts the shoulder.

6. The instrument of claim 1, further comprising at least one additional vent hole.

7. The instrument of claim 1, wherein the capillarity of the tip is greater than the capillarity of the buffer and greater than the capillarity of the vent hole.

8. The instrument of claim 1, wherein the tip is secured against substantial movement in the axial direction.

9. The instrument of claim 1, wherein the tip is disposed in interference fit within the feed tube.

10. The instrument of claim 1, wherein the vent hole is circular and has a diameter of about 5 thousandths of an inch to about 25 thousandths of an inch.

* * * * *